US009065189B2

(12) United States Patent
Ohnuma et al.

(10) Patent No.: US 9,065,189 B2
(45) Date of Patent: Jun. 23, 2015

(54) WATER PROOF CRIMPING TERMINAL AND CRIMPING METHOD OF WATER PROOF CRIMPING TERMINAL

(71) Applicant: YAZAKI CORPORATION, Tokyo (JP)

(72) Inventors: Kentaro Ohnuma, Shizuoka (JP); Hiroshi Kobayashi, Aichi-ken (JP); Takahito Nakashima, Aichi-ken (JP); Saori Muramatsu, Aichi-ken (JP)

(73) Assignee: YAZAKI CORPORATION, Tokyo (JP)

( * ) Notice: Subject to any disclaimer, the term of this patent is extended or adjusted under 35 U.S.C. 154(b) by 44 days.

(21) Appl. No.: 13/859,004

(22) Filed: Apr. 9, 2013

(65) Prior Publication Data

US 2013/0213710 A1 Aug. 22, 2013

Related U.S. Application Data

(63) Continuation of application No. PCT/JP2011/074234, filed on Oct. 14, 2011.

(30) Foreign Application Priority Data

Oct. 14, 2010 (JP) ..... 2010-231394

(51) Int. Cl.
*H01R 4/18* (2006.01)
*H01R 43/048* (2006.01)
(Continued)

(52) U.S. Cl.
CPC ..... *H01R 4/183* (2013.01); *Y10T 29/49204* (2015.01); *H01R 4/185* (2013.01); *H01R 13/52* (2013.01); *H01R 43/005* (2013.01); *H01R 43/048* (2013.01); *H01R 43/058* (2013.01)

(58) Field of Classification Search
CPC ..... H01R 4/183; H01R 13/52; H01R 43/005; H01R 43/048; H01R 4/185; H01R 43/058; Y10T 29/49204
USPC ..... 174/84 C, 94 R, 84 R; 439/877, 878, 882
See application file for complete search history.

(56) References Cited

U.S. PATENT DOCUMENTS 3,387,080 A 6/1968 Dibble et al.
5,414,926 A * 5/1995 Ito et al. ..... 29/753
(Continued)

FOREIGN PATENT DOCUMENTS

JP 08213142 A * 8/1996
JP 10-223265 A 8/1998
JP 2001-217013 A 8/2001

OTHER PUBLICATIONS

ISA210 and 230 for PCT/JP2011/074234 dated Jan. 23, 2012.
(Continued)

*Primary Examiner* — Hoa C Nguyen
*Assistant Examiner* — Amol Patel
(74) *Attorney, Agent, or Firm* — Kenealy Vaidya LLP

(57) ABSTRACT

A water proof crimping terminal comprises a base plate part; and a pair of core wire crimping pieces integrally formed with the base plate part to form an annular core wire crimping part during crimping process of an electric wire; wherein an end side of one of the core wire crimping pieces is folded outward to form a folded part having an outward repelling force, an end side of the other of the core wire crimping pieces is arranged outside the folded part as a covering part, and an outer surface of the folded part is allowed to come into close contact with an inner surface of the covering part by the repelling force.

2 Claims, 5 Drawing Sheets

(51) Int. Cl.

| | |
|---|---|
| ***H01R 13/52*** | (2006.01) |
| ***H01R 43/00*** | (2006.01) |
| *H01R 43/058* | (2006.01) |

(56) References Cited

U.S. PATENT DOCUMENTS

| | | | | |
|---|---|---|---|---|
| 5,561,267 | A | 10/1996 | Fudoo et al. | |
| 6,193,138 | B1 * | 2/2001 | Wada | 228/115 |
| 6,468,116 | B2 * | 10/2002 | Koide | 439/867 |
| 2001/0016460 | A1 | 8/2001 | Koide | |

OTHER PUBLICATIONS

Japanese Office Action for the related Japanese Patent Application No. 2010-231394 dated Sep. 2, 2014.

Korean Office Action for the related Korean Patent Application No. 10-2013-7009405 dated Sep. 24, 2014.

Copy of Chinese Office Action for the related Chinese Patent Application No. 201180049835.0 dated Jan. 16, 2015. X.

* cited by examiner

WATER PROOF CRIMPING TERMINAL AND CRIMPING METHOD OF WATER PROOF CRIMPING TERMINAL

CROSS REFERENCE TO RELATED APPLICATION

This application is a continuation of PCT application No. PCT/JP2011/074234, which was filed on Oct. 14, 2011 based on Japanese Patent Application No. 2010-231394 filed on Oct. 14, 2010, the contents of which are incorporated herein by reference. Also, all the references cited herein are incorporated as a whole.

BACKGROUND OF THE INVENTION

1. Field of the Invention

The present invention relates to a water proof crimping terminal and a crimping method of a water proof crimping terminal in which an adhesion of a core wire crimping part of the crimping terminal is improved to prevent an entry of water to a core wire part so that an amount of application of an anti-corrosive resin material to the core wire crimping part is reduced.

2. Description of the Related Art

Usually, in a crimping and connection of a terminal made of a copper alloy and an insulating coated electric wire having a core wire part made of aluminum, which are dissimilar metals, in order to prevent a galvanic corrosion (a dissimilar metal contact corrosion) occurring when water sticks to the crimping part of the core wire part and the terminal, various water proof units are proposed.

For instance, according to the disclosure of JP-A-2010-108829 (FIG. 1 to FIG. 4), as shown in FIGS. 5(*a*) and 5(*b*), a UV curing resin 53 resin 53 is applied to core wire parts exposed in front and rear parts of a pair of right and left core wire crimping pieces 52 of a terminal 51 to prevent the entry and adhesion of water to the core wire parts.

In FIGS. 5(*a*) and 5(*b*), reference numeral 54 designates an insulating coated crimping piece of the terminal 51 made of a copper alloy, 55 similarly designates a female type electric contact part and 56 designates an insulating coated part of an aluminum electric wire, respectively. JP-A-2010-108829 (FIG. 1 to FIG. 4 ) also discloses a form in which not only the front and rear parts of the core wire crimping pieces 52, but also entire parts of the core wire crimping pieces 52 and an entire part of the coated crimping piece 54 with a resin layer 53.

JP-A-7-73950 (FIG. 5, FIG. 8) discloses one example, not to waterproof, but to prevent an expansion of a core wire crimping part due to a thermal expansion of a core wire part of an electric wire, that one core wire crimping piece (a wire barrel) is formed to be longer than the other core wire crimping piece (a wire barrel), an end part of the one core wire crimping piece is folded outward to form a stepped part inside, both the core wire crimping pieces are overlapped and an upward bent end part of the other (inside) core wire crimping piece is engaged with the stepped part.

Further, the JP-A-7-73950 (FIG. 5, FIG. 8) discloses another example that an end part of a longer core wire crimping piece of an outer side is folded outward to form inside a protruding surface which protrudes inward and a shorter core wire crimping piece of an inner side is bent inward to form a recessed surface of an outer side and the protruding surface is engaged with the recessed surface.

However, in the above-described usual water proof structure of the crimping terminal shown in FIGS. 5(*a*) and 5(*b*) and disclosed in JP-A-2010-108829 (FIG. 1 to FIG. 4), there is a fear that when a gap is occasionally formed in a joint surface 56 between the a pair of core wire crimping pieces 52, water may enter the core wire parts inside the core wire crimping pieces 52 from the gap. To cancel this fear, the entire parts of the a pair of core wire crimping pieces 52 need to be covered with the resin material 53, and accordingly, there is possibility in that much time may be required to cure the resin material 53.

Further, in the usual crimping terminal disclosed in the JP-A-7-73950 (FIG. 5, FIG. 8), there is possibility in that since the longer core wire crimping piece of the outer side is folded outward or the shorter core wire crimping piece of the inner side is bent inward, a core wire accommodating area of the inner side is reduced to apply an excessive compressive deformation to a core wire part.

SUMMARY OF THE INVENTION

By considering the above-described problems, it is an object of the present invention to provide a water proof crimping terminal and a crimping method of a water proof crimping terminal that can not only prevent water from entering a core wire part of an inner side from a joint surface between a pair of core wire crimping pieces, but also prevent an excessive compressive deformation of the core wire part.

In order to achieve the above-described object, a water proof crimping terminal according to a first aspect of the present invention comprises a base plate part; and a pair of core wire crimping pieces integrally formed with the base plate part to form an annular core wire crimping part during crimping process of an electric wire; wherein an end side of one of the core wire crimping pieces is folded outward to form a folded part having an outward repelling force, an end side of the other of the core wire crimping pieces is arranged outside the folded part as a covering part, and an outer surface of the folded part is allowed to come into close contact with an inner surface of the covering part by the repelling force.

According to the above-described structure, under a state that a core wire part of the electric wire is attached under pressure and connected the core wire crimping part, the folded part of the end side of the one bent core wire crimping piece comes into strong and tight contact with the covering part of the end side of the other bent core wire crimping piece without a gap by the repelling force (a resilient force) that is apt to restore the folded part outward on a folded base end as a supporting point. Accordingly, water is assuredly prevented from entering inside (the core wire part side) from a part between the covering part and the folded part. Thus, an anti-corrosive resin material does not need to be applied over an entire length of the core wire crimping part. The anti-corrosive resin material may be merely applied to two positions of core wire exposed parts protruding to front and rear parts of the core wire crimping part.

For instance, when the end side of the other core wire crimping piece is folded inward to form a folded part, the other core wire crimping piece formed integrally with the folded part is urged outward by an inward repelling force of the inward folded part (since one core wire crimping piece located inside the folded part strongly abuts on the core wire part of an inner side), the repelling force escapes outside to lower an adhesion to the one core wire crimping piece. When the outward folded part is formed in the one core wire crimping piece and the covering part of the other core wire crimping piece separate (discontinuous to) from the folded part is arranged outside the folded part, the repelling force of the folded part does not escape outside and the folded part strongly comes into close contact with the covering part as the separate member.

In a water proof crimping terminal defined in a second aspect of the present invention, an end of the covering part is extended to be longer than an end of the folded part in the water proof crimping terminal according to the first aspect of the invention.

According to the above-described structure, the covering part which is extended to be long comes into close contact with the folded part with an inward crimping force larger than that when the covering part is not extended to improve an adhesion (a water proof property) between the inner surface of the covering part and the outer surface of the folded part.

A crimping method of a water proof crimping terminal defined in a third aspect of the present invention relates to a crimping method of the water proof crimping terminal according to the first aspect of the present invention comprises continuously forming a pair of curved surfaces through a stepped surface in a crimper that is opposed to an anvil; arranging the other of the curved surfaces outside a virtual extending surface of one of the curved surfaces; arranging the one of the core wire crimping pieces along the one of the curved surfaces; arranging the other of the core wire crimping pieces along the other of the curved surfaces; and allowing an end of the covering part to abut on the stepped surface and pressing the core wire crimping part by the anvil and the crimper.

According to the above-described structure, the end of the other core wire crimping piece, that is, the end of the covering part abuts on the stepped surface of the crimper. The covering part is accommodated in a space (a space formed by the stepped surface) between a virtual extending line of the one curved surface and the other curved surface. The folded part of an outer side of the end of the one core wire crimping piece slides along the inner surface of the covering part from the one curved surface, and at this time, both the core wire crimping pieces are smoothly attached under pressure in a bent form so as to reduce a diameter (crimping). Since the covering part is engaged with the space formed by the stepped surface, an unnecessary inward compressive deformation of the folded part by the covering part is prevented, an accommodating space of the core wire part is ensured and an excessive compressive deformation of the core wire part is prevented.

In a crimping method of a water proof crimping terminal defined in a fourth aspect of the present invention, the folded part is separated outward from the one of the core wire crimping pieces before the crimping process of the electric wire in the crimping method of the water proof crimping terminal according to the third aspect of the invention.

According to the above-described structure, under a state before the crimping process (during a formation of the terminal), the folded part is folded outward at an opening angle (an acute angle) to some degree on a bent part as a supporting point. Thus, the outward repelling force is given to the folded part.

According to the first aspect of the present invention, since a pair of outward folded parts of the one core wire crimping piece are allowed to come into resiliently close contact with the covering part of the other core wire crimping piece of the outer side to change the repelling force of the folded parts to an adhesion without freeing the repelling force, water can be assuredly prevented from entering the core wire part from the part between the folded parts and the covering part. Thus, the anti-corrosive resin material does not need to be applied over the entire length of the core wire crimping part. The anti-corrosive resin material may be merely applied to the core wire exposed parts in the front and rear parts of the core wire crimping part. Thus, the curing time of the anti-corrosive resin material can be shortened, an amount of use (cost) of the anti-corrosive resin material can be reduced and the number of production processes and the cost of the crimping terminal having the electric wire can be reduced.

According to the second aspect of the present invention, since the extended covering part is allowed to strongly come into close contact with the folded part of an inner side with a large inward crimping force, the water proof property of the core wire crimping part can be improved.

According to the third aspect of the present invention, the one curved surface of an inner side and the other curved surface of an outer side continuous to the stepped surface are formed in the crimper. The covering part is accommodated in an inner space of the curved surface of the outer side. The folded part is slid along the inner surface of the covering part, so that both the core wire crimping pieces can be smoothly and assuredly attached under pressure without a forcible deformation. Thus, the covering part can be smoothly and assuredly allowed to come into close contact with the folded part to improve the water proof property and prevent the forcible compressive deformation of the core wire part or element wires from being cut due to the forcible compressive deformation of the core wire part.

According to the fourth aspect of the present invention, since the outward repelling force is given to the folded part under a free state of the crimping terminal, the folded part can be allowed to resiliently come into close contact with the covering part of the outer side due to the repelling force during the crimping process of the electric wire. Thus, the water proof property can be improved between the folded part and the covering part.

BRIEF DESCRIPTION OF THE DRAWINGS

FIG. 5(*a*) is a side view and FIG. 5(*b*) is a plan view.

DESCRIPTION OF THE PREFERRED EMBODIMENTS

Figure 1:
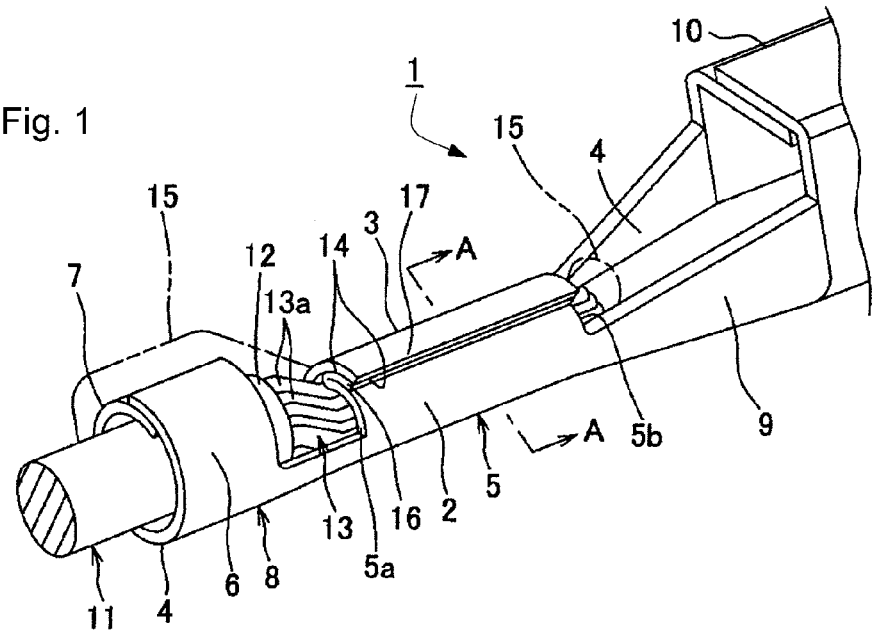
FIG. 1 is a perspective view showing one exemplary embodiment of a water proof crimping terminal according to the present invention.
Figure 2:
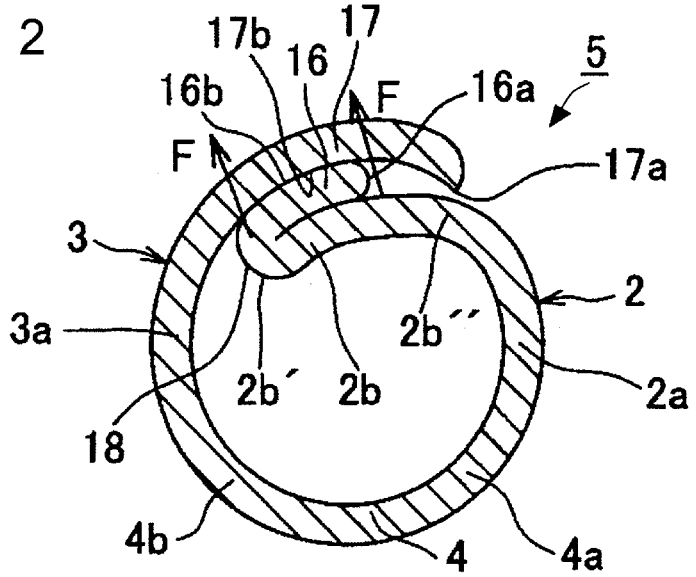
FIG. 2 is a sectional view taken along a line A-A of FIG. 1 which shows one example of a core wire crimping part of the crimping terminal.
Figure 3:
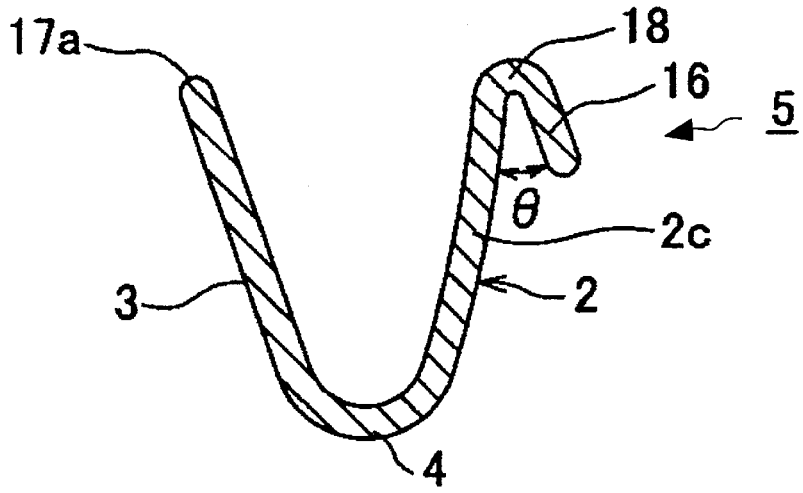
FIG. 3 is a sectional view showing one example of a form of the core wire crimping part before a crimping operation.
Figure 4A:
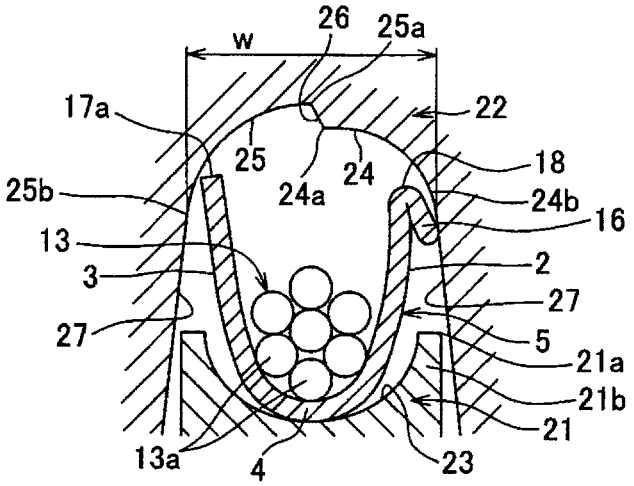
FIG. 4(*a*) to FIG. 4(*c*) are longitudinally sectional views showing in order a method for allowing a core wire part of an electric wire to come into crimping with the core wire crimping part by an anvil and a crimper.
Figure 4B:
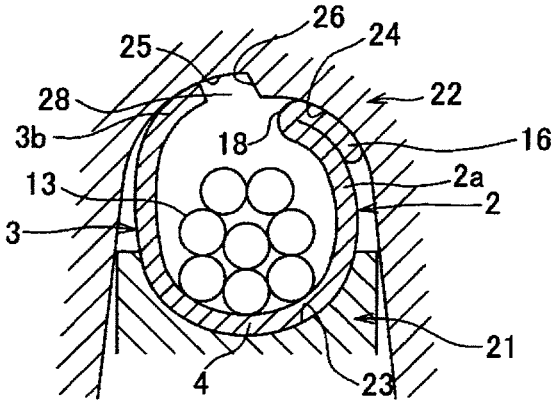
Figure 4C:
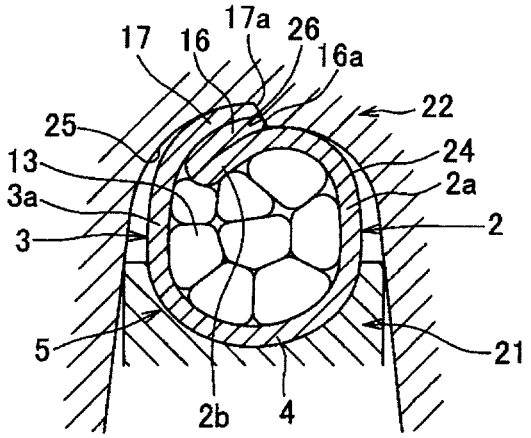
Figure 5A:
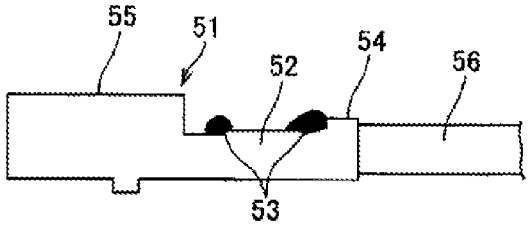
Fig. 5(a) CONVENTIONAL ART
FIG. 5(*a*) and FIG. 5(*b*) show one form of a usual water proof crimping terminal.
Figure 5B:
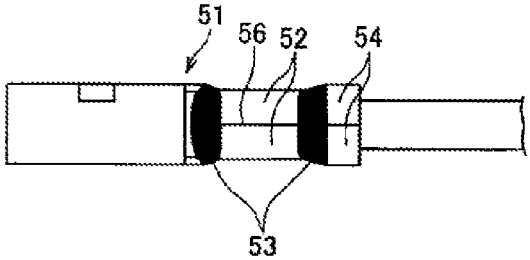
Fig. 5(b) CONVENTIONAL ART

FIG. 1 shows one exemplary embodiment of a water proof crimping terminal according to the present invention. FIG. 2 similarly shows a structure of a core wire crimping part of the water proof crimping terminal (an illustration of an electric wire is omitted). FIG. 3 to FIGS. 4(*a*) to 4(*c*) similarly show one exemplary embodiment of a crimping method of the water proof crimping terminal.

As shown in FIG. 1, the water proof crimping terminal 1 includes an annular core wire crimping part 5 having a pair of right and left overlapped core wire crimping pieces 2 and 3, an annular insulating coat crimping part 8 having a pair of right and left insulating coat crimping pieces 6 and 7 in a rear part of the core wire crimping part 5 and a box shaped female type electric contact part 10 continuous to the core wire crimping part 5 through a horizontal base plate part (a bottom plate part) 4 and right and left vertical side walls 9 in the front part of the core wire crimping part 5.

An insulating coat 12 in an end side of an insulating coated electric wire 11 is peeled off to expose a core wire part 13 composed of a plurality of element wires 13*a* so that an outer surface of the core wire part 13 comes into close contact with an inner surface of the one (the right side) core wire crimping piece 2 and an inner surface of the other (the left side) core wire crimping piece 3 lapped on (overlapped on) an outer side of the one core wire crimping piece 2. Thus, joint surfaces 14 of the a pair of core wire crimping pieces 2 and 3 come into diametrically strong and tight contact with each other to prevent water from entering inside from the joint surfaces 14.

Thus, in the core wire crimping part 5 (in a range from rear ends 5*a* to front ends 5*b* of the core wire crimping pieces 2 and 3), an anti-corrosive resin material 15 does not need to be applied. Accordingly, the anti-corrosive resin material 15 (shown by a chain line) may be merely applied to two parts in total including a periphery (an upper side) of the insulating coat crimping part 8 and a periphery of a core wire end part protruding short from the front end 5*b* of the core wire crimping part 5. Thus, a curing time of the anti-corrosive resin material 15 necessary when the anti-corrosive resin material 15 is applied to the core wire crimping part 5 longer than the insulating coat crimping part 8 can be reduced and the short and small anti-corrosive resin material 15 of the two parts can be cured in a short time.

The core wire crimping part 5 includes the pair of core wire crimping pieces 2 and 3 and the base plate part 4 integrally formed with the pair of core wire crimping pieces 2 and 3 and continuous to a lower side of the pair of core wire crimping pieces 2 and 3 within a range of the length of the core wire crimping pieces 2 and 3 in a forward and rearward direction. Similarly, the insulating coat crimping part 8 includes the pair of insulating coat crimping pieces 6 and 7 and the base plate part 4 integrally formed with the pair of insulating coat crimping pieces 6 and 7 and continuous to a lower side of the pair of insulating coat crimping pieces 6 and 7 within a range of the length of the insulating coat crimping pieces 6 and 7. The base plate part 4 is also referred to as the bottom plate part and integrally continuous from the rear end of the insulating coat crimping part 8 to the front end of the female type electric contact part 10 in the longitudinal direction of the terminal.

As shown in FIG. 2, the annular core wire crimping part 5, after the electric wire is caulked, includes the circular arc shaped base plate part 4 in a lower side, the one core wire crimping piece 2 bent (a bent part is designated by reference numeral 2*a*) inward in a diametrical direction subsequently to one side part (a right side part in this exemplary embodiment) 4*a* of the base plate part 4 and folded (a folded part is designated by reference numeral 16) upward and outward in the diametrical direction in an end side of the bent part 2*a* and the other core wire crimping piece 3 bent (a bent part is designated by reference numeral 3*a*) inward in the diametrical direction subsequently to the other side part (a left side part in this exemplary embodiment) 4*b* of the base plate part 4 and having a covering part 17 lapped on (overlapped on) an upper side of the folded part 16 to come into close contact therewith in an end side of the bent part 3*a*.

In an example of FIG. 2, an end side (an upper side) part of the one (the right side) bent part 2*a* is slightly inclined leftward and downward (an inclined part is designated by reference numeral 2*b*). An end 2*b*' of the inclined part 2*b* is located in the other (the left) side from a virtual central line of the core wire crimping part 5 in a vertical direction. The folded part 16 slightly inclined rightward and upward is located in the upper side of the inclined part 2*b*. An end 16*a* of the folded part 16 is substantially located on the virtual central line in the vertical direction.

A base end of the folded part 16 is integrally continuous to the end of the inclined part 2*b* through a circular arc (a semicircular) shaped bent part 18. The folded part 16 has a resilient force (a repelling force) directed outward in the diametrical direction as shown by an arrow mark F relative to the inclined part 2*b* on the bent part 18, that is, an intersecting part of the inclined part 2*b* and the folded part 16 as a supporting point. Thus, a curved outer surface 16*b* of the folded part 16 comes into strong and tight contact with a curved inner surface 17*b* of the covering part 17 of an outer side by the resilient force of the folded part 16.

In the example of FIG. 2, the covering part 17 is extended clockwise to be longer than the end 16*a* of the folded part 16. An end inner surface 17*a* of the covering part 17 comes into contact with an outer surface of a base part side part 2*b*" of the inclined part 2*b*. The covering part 17 has a resilient force directed inward in the diametrical direction. The outer surface 16*b* of the folded part 16 comes into close contact with the inner surface 17*b* of the covering part 17 by the outward resilient force of the folded part 16. At the same time, the inner surface 17*b* of the covering part 17 extended to be long comes into close contact with the outer surface 16*b* of the folded part 16 by the inward resilient force of the covering part 17. Thus, the water is assuredly prevented from entering the core wire part 13 (FIG. 1) of an inner side from a part (the joint surfaces 14) between the folded part 16 and the covering part 17, and, in FIG. 1, the anti-corrosive resin material 15 does not need to be applied over an entire length of the core wire crimping part 5 (from the front end 5*b* to the rear end 5*a*).

In FIG. 2, even when the covering part 17 is not extended and is formed so as to have substantially the same length as that of the folded part 16, since the covering part 17 has the inward resilient force, which is not the same as that obtained when the covering part 17 is extended, and the folded part 16 has an unchanged outward resilient force, the covering parts 17 assuredly comes into contact with the folded part 16 without a gap, the water is prevented from entering the core wire part 13 from the joint surfaces 14 and the anti-corrosive resin material 15 does not need to be applied over the entire length of the core wire crimping part 5.

FIG. 3 shows a free state of the core wire crimping part 5 shown in FIG. 2 before a crimping operation thereof. The one (the right side) core wire crimping piece 2 includes a long inclined part 2*c* which is inclined rightward and upward (outward) and the folded part 16 which is shortly inclined rightward and downward (outward). The base end (the upper end) of the folded part 16 is integrally continuous to an end (an upper end) of the inclined part 2*c* through the circular arc shaped bent part 18 having a small diameter. An opening angle θ formed by the inclined part 2*c* and the folded part 16 is substantially about 35° (preferably, an acute angle) as one example, and a little smaller than an opening angle formed by the one (the right side) core wire crimping piece 2 and the other (the left side) core wire crimping piece 3 of this exemplary embodiment. The folded part 16 has a resilient force in the direction (inward and outward) of thickness of a plate relative to the inclined part 2*c* on the bent part 18 as a supporting point.

The other (the left side) core wire crimping piece 3 is extended and inclined leftward and upward (outward) substantially to the same height as that of the bent part 18 as the upper end of the one core wire crimping piece 2. An end (an upper end) of the other core wire crimping piece 3 is designated by reference numeral 17*a*. The width (the length in the forward and rearward direction in FIG. 1) and the thickness of the plate of the right and left core wire crimping pieces 2 and 3 are respectively the same. The core wire crimping pieces 2 and 3 shown in FIG. 3 respectively protrude obliquely and outward (raised) from the base plate part 4 bent in a circular arc shape. The core wire crimping part 5 is formed by the base plate part 4 and the core wire crimping pieces 2 and 3 respectively. The core wire crimping part 5 shown in FIG. 3 is deformed by a crimping operation as shown in FIG. 2 in accordance with crimping processes shown in FIGS. 4(*a*) to 4(*c*).

Namely, as shown in FIG. 4(*a*), the core wire crimping part 5 shown in FIG. 3 is set on an anvil 21 as a lower mold made of metal and a crimper 22 as an upper mold made of metal is located in an upper part of the core wire crimping part 5. The crimping terminal 1 (FIG. 1) including the core wire crimping part 5 of the present exemplary embodiment is formed with a copper alloy good in its resiliency.

The anvil 21 includes a receiving circular arc shaped curved surface 23 and side walls 21*b* at both right and left sides of the curved surface 23. The crimper 22 includes a pair of right and left pressing circular arc shaped curved surfaces 24 and 25 having substantially the same inside diameter as that of the curved surface 23 of the anvil 21. The right side (the one) curved surface 24 is continuous to the left side (the other) curved surface 25 through an inclined stepped surface 26 which is inclined leftward and upward and nearly vertical. The left side curved surface 25 is arranged diametrically outside a virtual extending surface of the right side curved surface 24 which is not shown in the drawing.

An apex 24*a* of the right side curved surface 24 is continuous to a lower end of the stepped surface 26 and an upper end of the stepped surface 26 is continuous to an apex 25*a* of the left side curved surface 25. The apex 25*a* of the left side curved surface 25 is located at a position higher than the apex 24*a* of the right side curved surface 24. Lower ends 24*b* and 25*b* of the right and left curved surfaces 24 and 25 are located substantially at the same height. The lower ends 24*b* and 25*b* of the right and left curved surfaces 24 and 25 are respectively continuous to tapered inclined surfaces 27 which are slightly inclined outward and nearly vertical. The inclined surfaces 27 come close respectively to right and left upper ends 21*a* of the anvil 21. In FIG. 4(*a*), sign W designates a mold C/W (crimper wide), namely, a dimension of width between the lower ends 24*b* and 25*b* of the right and left curved surfaces 24 and 25 of the crimper 22.

In FIG. 4(*a*), the base plate part (the bottom plate part) 4 of the core wire crimping part 5 comes into contact with a central part in the direction of width of the curved surface 23 of the anvil 21. The core wire part 13 composed of the plurality of element wires 13*a* of the electric wire 11 (FIG. 1) is set inside the core wire crimping part 5. An outer surface of an end (a lower end) side of the folded part 16 in the end side of the right side core wire crimping piece 2 abuts on an upper end side of the inclined surface 27 of the crimper 22. At this time, the folded part 16 is slightly pressed inward to be bent on the bent part 18 of the upper side of the folded part 16 as a supporting point. An outer end of the end (the upper end) 17*a* of the left side core wire crimping piece 3 abuts on a lower end side of the left side curved surface 25.

The crimper 22 is integrally lowered by a ram of a hydraulic cylinder not shown in the drawing from a state shown in FIG. 4(*a*). During a lowering movement, as shown in FIG. 4(*b*), the outer surface of the folded part 16 comes into contact with the right side curved surface 24 of the crimper 22, and, at this time, the folded part 16 is pressed inward in a diametrical direction of the electric wire to be bent in the direction of thickness of the plate on the bent part 18 as a supporting point. At the same time, the core wire crimping piece 2 is bent (the bent part is designated by reference numeral 2*a*). Thus, an inner surface of the folded part 16 comes into contact with an outer surface of the bent part 2*a* or comes close thereto. An end side part 3*b* of the left side core wire crimping piece 3 is bent along the left side curved surface 25 of the crimper 22. The base plate part 4 is bent in the shape of a circular arc along the curved surface 23 of the anvil 21.

When the crimper 22 is further lowered from a state shown in FIG. 4(*b*), as shown in FIG. 4(*c*), the right side core wire crimping piece 2 is bent inward to reduce a diameter. At this time, the folded part 16 passes the stepped surface 26 at the center of the crimper 22 and the end 16*a* of the folded part 16 is located substantially in a lower side of the stepped surface 26. The end 17*a* of the left side core wire crimping piece 3 abuts on the stepped surface 26, and at this time, the end side part of the core wire crimping piece 3 is bent inward to form the covering part 17. The folded part 16 is guided leftward along the inner surface of the covering part 17 to smoothly enter inside the covering part 17. The covering part 17 is pressed to the folded part 16 in a lower side by the left side curved surface 25 to come into close contact with the folded part 16.

The folded part 16 is pressed inward by the covering part 17 to allow the leftward and downward inclined part 2*b* in the end side of the bent part 2*a* to bite inward to the core wire part 13. The core wire part 13 is surrounded by the bent parts 2*a* and 3*a* of the right and left core wire crimping pieces 2 and 3, the right side inclined part 2*b* and the bent base plate part 4, compressed in the diametrical direction to come into close contact with inner surfaces of the parts 2*a*, 3*a*, 2*b* and 4 respectively and connected thereto.

Under a state shown in FIG. 4(*c*), the crimping processes are completed. Thus, the crimper 22 is lifted together with the ram and the annular core wire crimping part 5 is released from a pressing force of the crimper 22 and the anvil 21. The folded part 16 is pressed to the covering part 17 to come into close contact therewith by an outward restoring force of itself and an outward repelling force of the core wire part 13 acting on the inclined part 2*b*. Thus, water is assuredly prevented from entering the core wire part 13 from a part between the covering part 17 and the folded part 16. To prevent a corrosion of the terminal and the core wire part made of dissimilar metals, for instance, the terminal 1 made of a copper alloy and the core wire part 13 made of aluminum, the above-described close contact operation of the folded part 16 and the covering part 17 is especially effective.

In an example shown in FIG. 4(*c*), the end 17*a* of the covering part 17 and the end 16*a* of the folded part 16 are located substantially on the same virtual vertical plane in the vertical direction. However, for instance, in FIG. 4(*a*), when the stepped surface 26 is shifted rightward from the center and the left side curved surface 25 is set to be longer than the right side curved surface 24 (in FIG. 3, the left side core wire crimping piece 3 is preferably set to be longer than the right side core wire crimping piece 2), the form of the extended covering part 17 shown in FIG. 2 is obtained.

As shown in FIG. 4(*c*), since the covering part 17 as the end side part of the left side core wire crimping piece 3 is accommodated in a space 28 (FIG. 4(*b*)) located inside the stepped surface 26 and the left side curved surface 25 subsequent thereto, the covering part 17 does not allow the folded part 16 of the lower side or the inclined part 2*b* to forcibly bite inside the core wire part 13. Thus, an accommodating space of the of the core wire part 13 in the core wire crimping part 5 is held to have a substantially circular form, an unreasonable compression force is not applied to the core wire part and an excessive compression deformation of the core wire part 13 is prevented.

In the exemplary embodiment shown in FIG. 1, as the terminal, a female side crimping terminal 1 is used that has the box shaped electric contact part (having a resilient contact piece therein) 10. However, a male type crimping terminal may be used in which a male type electric contact part (not shown in the drawing) such as a tab type or a pin type is formed continuously to a base plate part 4. Further, a crimping terminal for a joint may be used in which an electric contact part 10 is not formed and a core wire part 13 of a plurality of electric wires 11 is attached to a core wire crimping part 5 by a joint crimping.

Further, in the above-described exemplary embodiment, the folded part 16 is formed in the right side core wire crimping piece 2 and the covering part 17 is formed in the left side core wire crimping piece 3, however, a covering part 17 may be formed in a right side core wire crimping piece 2 and a folded part 16 may be formed in a left side core wire crimping piece 3 symmetrically with the form of the above-described exemplary embodiment (the folded part 16 is arranged inside the covering part 17 similarly to the above-described exemplary embodiment).

Further, the present invention may be effectively applied to a structure of a core wire crimping part of a crimping terminal or a method for forming a core wire crimping part as well as to the water proof crimping terminal and the crimping method of the water proof crimping terminal.

The water proof crimping terminal and the contact pressure method of the water proof crimping terminal can be used to reduce an amount of application of the anti-corrosive resin material to the core wire crimping part of the crimping terminal, shorten a curing time of the anti-corrosive resin material, suppress a consumed cost of the anti-corrosive resin material and shorten a cycle time, for instance, from a production of a crimping terminal having an electric wire to an insertion of the crimping terminal having the electric wire into a connector housing made of an insulating resin which forms a connector of a wire harness.

What is claimed is:

1. A crimping method of a water proof crimping terminal which comprises a base plate part and a pair of core wire crimping pieces integrally formed with the base plate part to form an annular core wire crimping part during crimping process of an electric wire, wherein an end side of one of the core wire crimping pieces is folded outward to form a folded part having an outward repelling force, and an end side of the other of the core wire crimping pieces is arranged outside the folded part as a covering part, and an outer surface of the folded part is allowed to come into close contact with an inner surface of the covering part by the repelling force, the crimping method comprising the steps of:

forming a pair of curved surfaces through a stepped surface in a crimper that is opposed to an anvil, wherein the curved surfaces have one curved surface and the other curved surface arranged outside a virtual extending surface of the one curved surface, the stepped surface formed between the one curved surface and the other curved surface;

arranging the folded part, in which the end side of the one of the core wire crimping pieces is folded outward, so as to contact the one curved surface along the one of the curved surfaces;

arranging the one of the core wire crimping pieces along the one of the curved surfaces;

arranging the other of the core wire crimping pieces along the other of the curved surfaces; and allowing an end of the covering part to abut on the stepped surface and pressing the core wire crimping part by the anvil and the crimper, thus the end of the covering part being accommodated in a space of the stepped surface.

2. The crimping method of a water proof crimping terminal according to claim 1, wherein the folded part is separated outward from the one of the core wire crimping pieces before the crimping process of the electric wire.

* * * * *